US006886871B1

(12) United States Patent
Shen

(10) Patent No.: US 6,886,871 B1
(45) Date of Patent: May 3, 2005

(54) FIREPROOF COVER FOR A TUBULAR LOCK

(76) Inventor: Mu-Lin Shen, No. 18, Industry 3 Rd., An-Nan District, Tainan (TW)

( * ) Notice: Subject to any disclaimer, the term of this patent is extended or adjusted under 35 U.S.C. 154(b) by 0 days.

(21) Appl. No.: 10/726,208

(22) Filed: Dec. 1, 2003

(51) Int. Cl.[7] ..... E05B 63/20

(52) U.S. Cl. ..... 292/336; 292/357; 292/DIG. 2; 292/DIG. 59

(58) Field of Search ..... 292/357, 356, 292/358, DIG. 2, DIG. 59, DIG. 65, DIG. 66

(56) References Cited

U.S. PATENT DOCUMENTS 5,564,296 A * 10/1996 Theriault et al. ..... 70/224
5,732,578 A * 3/1998 Kang ..... 70/224
5,761,936 A * 6/1998 Katayama ..... 70/224
6,302,457 B1 * 10/2001 Shen ..... 292/357
6,581,423 B2 * 6/2003 Lin ..... 70/107

* cited by examiner

*Primary Examiner*—John B. Walsh
(74) *Attorney, Agent, or Firm*—Alan D. Kamrath; Nikolai & Mersereau, P.A.

(57) ABSTRACT

A tubular lock includes an inside assembly having an inside rose and an inside rose liner, an outside assembly having an outside rose and an outside rose liner, a latch mechanism including a latch, at least one of the inside assembly and the outside assembly having a spindle operably connected to the latch for retracting the latch and a handle connected to the spindle to turn therewith, and a fireproof cover having a longitudinal through-hole through which the spindle extends. The fireproof cover is mounted outside the outside rose liner and thus covers the outside rose liner. The inside rose liner, the outside rose liner, and the fireproof cover are engaged together.

7 Claims, 8 Drawing Sheets

FIREPROOF COVER FOR A TUBULAR LOCK

BACKGROUND OF THE INVENTION

1. Field of the Invention

The present invention relates to a fireproof cover for a tubular lock.

2. Description of the Related Art

FIGS. 1 and 2 of the drawings illustrate a conventional tubular lock comprising an inside assembly 1, an outside assembly 2, and a latch mechanism 3. The inside assembly 1 includes an inside handle 11, an inside rose 12, an inside rose liner 13 mounted inside the inside rose 12, and an inside spindle 16 extending through the inside rose 12 and the inside rose liner 13. The outside assembly 2 includes an outside handle 21, an outside rose 22, an outside rose liner 23 mounted inside the outside rose 22, and an outside spindle 26 extending through the outside rose 22 and the outside rose liner 23. A housing 24 is formed on an inner face of the outside rose liner 23, and a locking/unlocking bar 25 is mounted to an end of the outside spindle 26.

The latch mechanism 3 is mounted between the inside rose liner 13 and the outside rose liner 23 and includes a casing 30, a latch 31, and a cam 32 that has a through-hole 321 through which the locking/unlocking bar 25 extends. When either handle 11, 21 is turned, the locking/unlocking bar 25 is turned to retract the latch 31 inward, achieving the unlatching operation.

The housing 24 includes two diametrically disposed mounting portions 241 each having a screw hole 242, and the inside rose liner 13 includes two holes 130 aligned with the screw holes 242, with two screws 14 respectively extending through the holes 130 of the inside rose liner 13 into the screw holes 242 of the housing 24. The inside rose liner 13 and the outside rose liner 23 are thus engaged, and the main portion of the lock is fixed in a borehole 81 of a door 8.

To assure sufficient strength for the lock and to cut the manufacturing cost, most parts of the conventional tubular lock are made of zinc alloy. Although zinc is cheaper than steel and possesses certain strength, the zinc alloy has a low melting point. Thus, when the tubular lock is mounted to a fireproof door, the outside rose liner 23 and the housing 24 melt when subjected to fire, as the mounting portion 241 inside the outside rose liner 23 is formed on the housing 24 that has a relatively low strength. As a result, as illustrated in FIG. 3, the inside rose liner 13 and the outside rose liner 23 are disengaged from the door and fall, exposing the borehole 81 in the door 8. The fireproof door malfunctions, as smoke and fire could not be barred.

SUMMARY OF THE INVENTION

An object of the present invention is to provide a fireproof cover for a tubular lock mounted to a fireproof door. The tubular lock has a simple structure with improved strength without increasing the manufacturing cost thereof.

In accordance with an aspect of the invention, a tubular lock comprises an inside assembly including an inside rose and an inside rose liner, an outside assembly including an outside rose and an outside rose liner, a latch mechanism including a latch, at least one of the inside assembly and the outside assembly including a spindle operably connected to the latch for retracting the latch and a handle connected to the spindle to turn therewith, and a fireproof cover including a longitudinal through-hole through which the spindle extends. The fireproof cover is mounted outside the outside rose liner and thus covers the outside rose liner. The inside rose liner, the outside rose liner, and the fireproof cover are engaged together.

When the tubular lock is mounted to a door, the outside rose liner may melt when subject to fire, yet the fireproof cover will not. Disengagement between the inside rose liner and the outside rose liner will not occur. A reliable fire and smoke barrier is provided while increasing the structural strength of the tubular lock itself.

In an embodiment of the invention, the outside rose liner includes a housing extending from an inner face thereof. The housing includes two mounting portions each having a screw hole. The inside rose liner includes two holes respectively aligned with the screw holes of the outside rose liner. The fireproof cover includes two legs each having an end piece on a distal end thereof. The respective end piece has a hole aligned with the respective screw hole of the outside rose liner. Two screws are respectively extending through the holes of the inside rose liner and the holes of the fireproof cover into the screw holes of the outside rose liner. The hole of the respective leg of the fireproof cover is preferably a screw hole.

The housing includes two notches through which the legs of the fireproof cover respectively extend. The respective leg of the fireproof cover has a length slightly greater than an axial length of the housing. The respective leg of the fireproof cover includes a protrusion. Two spring clips are provided for retaining the legs of the fireproof cover in place. The respective spring clip is a substantially U-shaped member including an intermediate portion and two hooks formed on two distal ends thereof. The intermediate portion of the respective spring clip abutting against the protrusion of the respective leg of the fireproof cover, with the hooks of the respective spring clip being engaged with an end wall of the housing.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
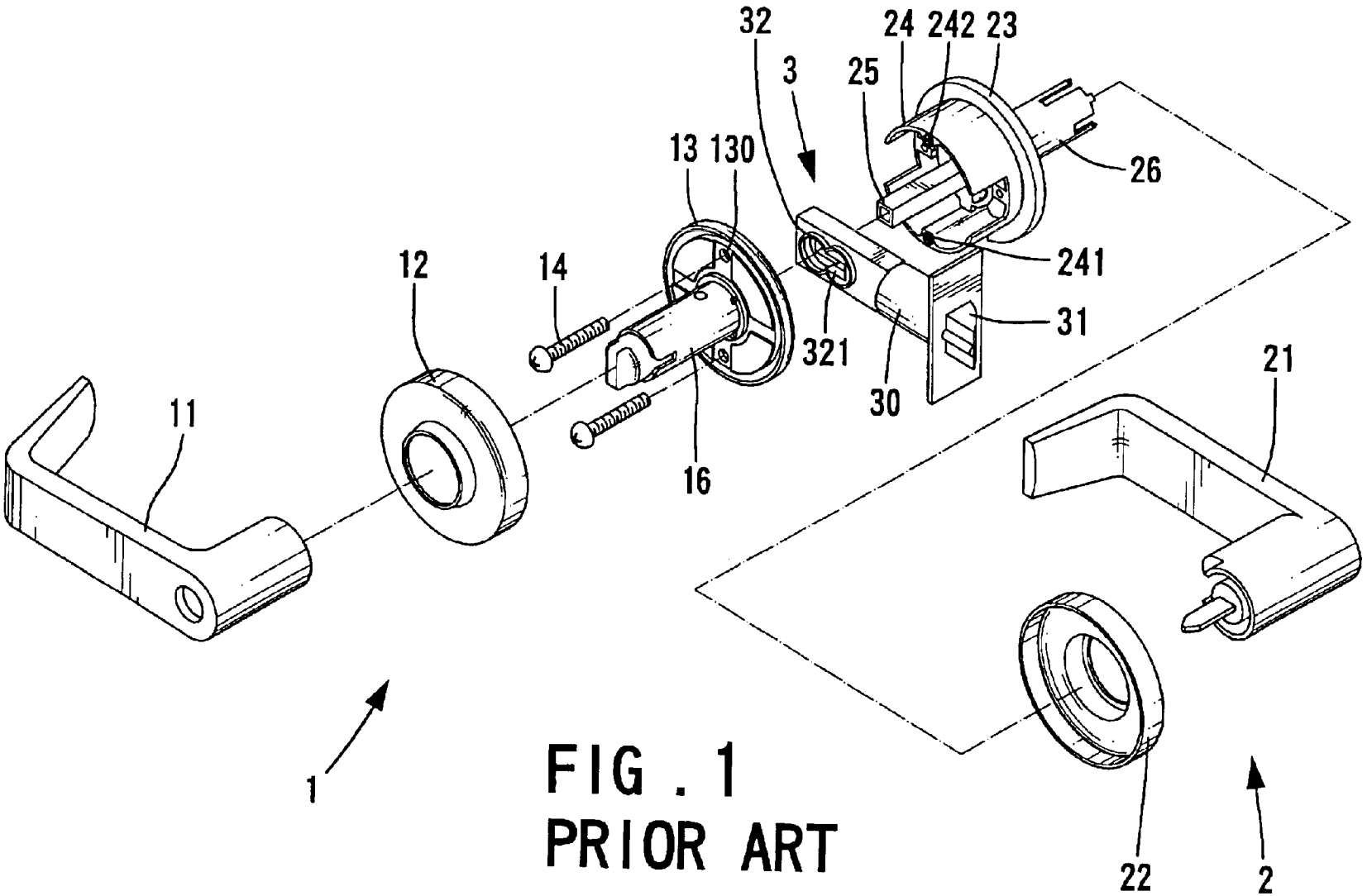
FIG. 1 PRIOR ART
FIG. 1 is an exploded perspective view of a conventional tubular lock.
Figure 2:
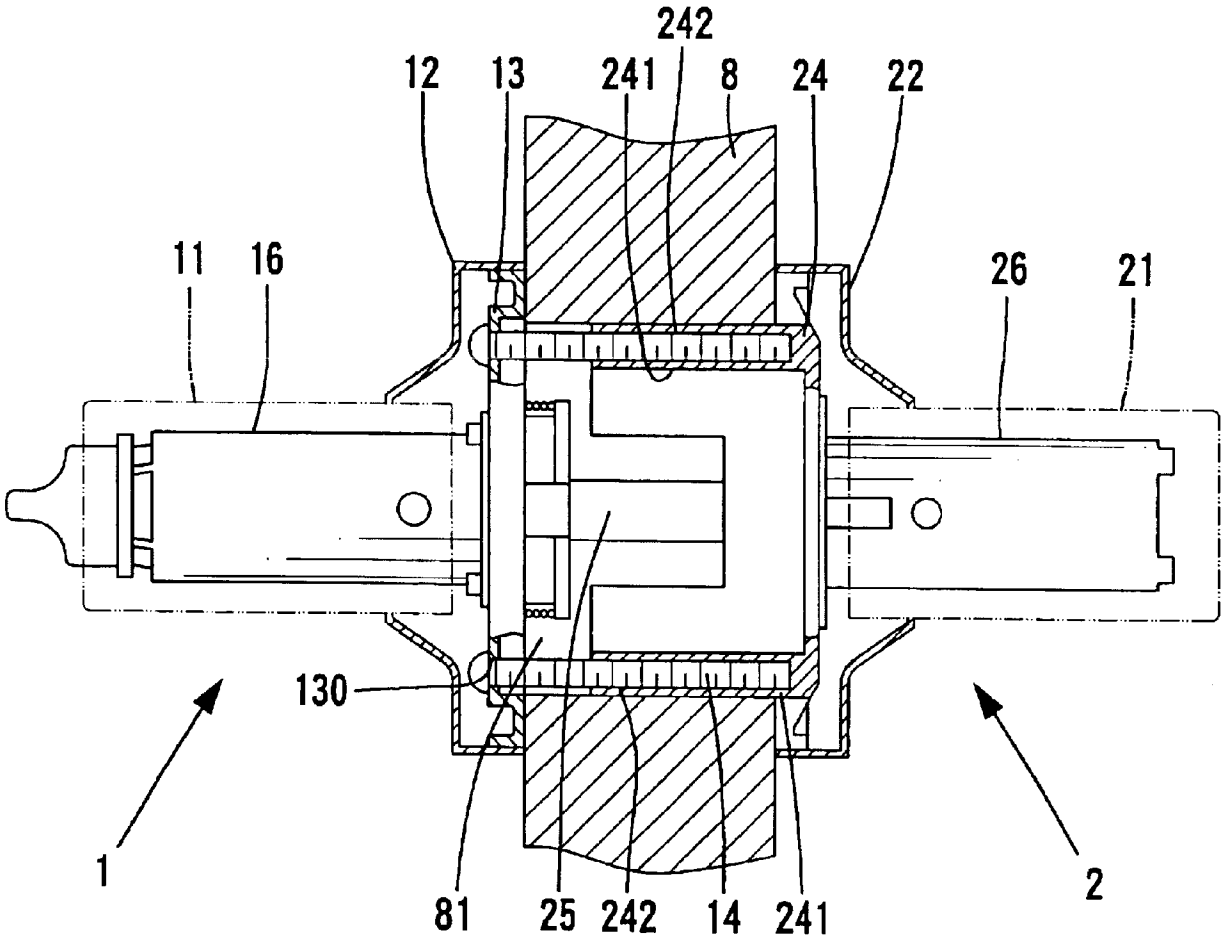
FIG. 2 PRIOR ART
FIG. 2 is a sectional view of the conventional tubular lock mounted to a door.
Figure 3:
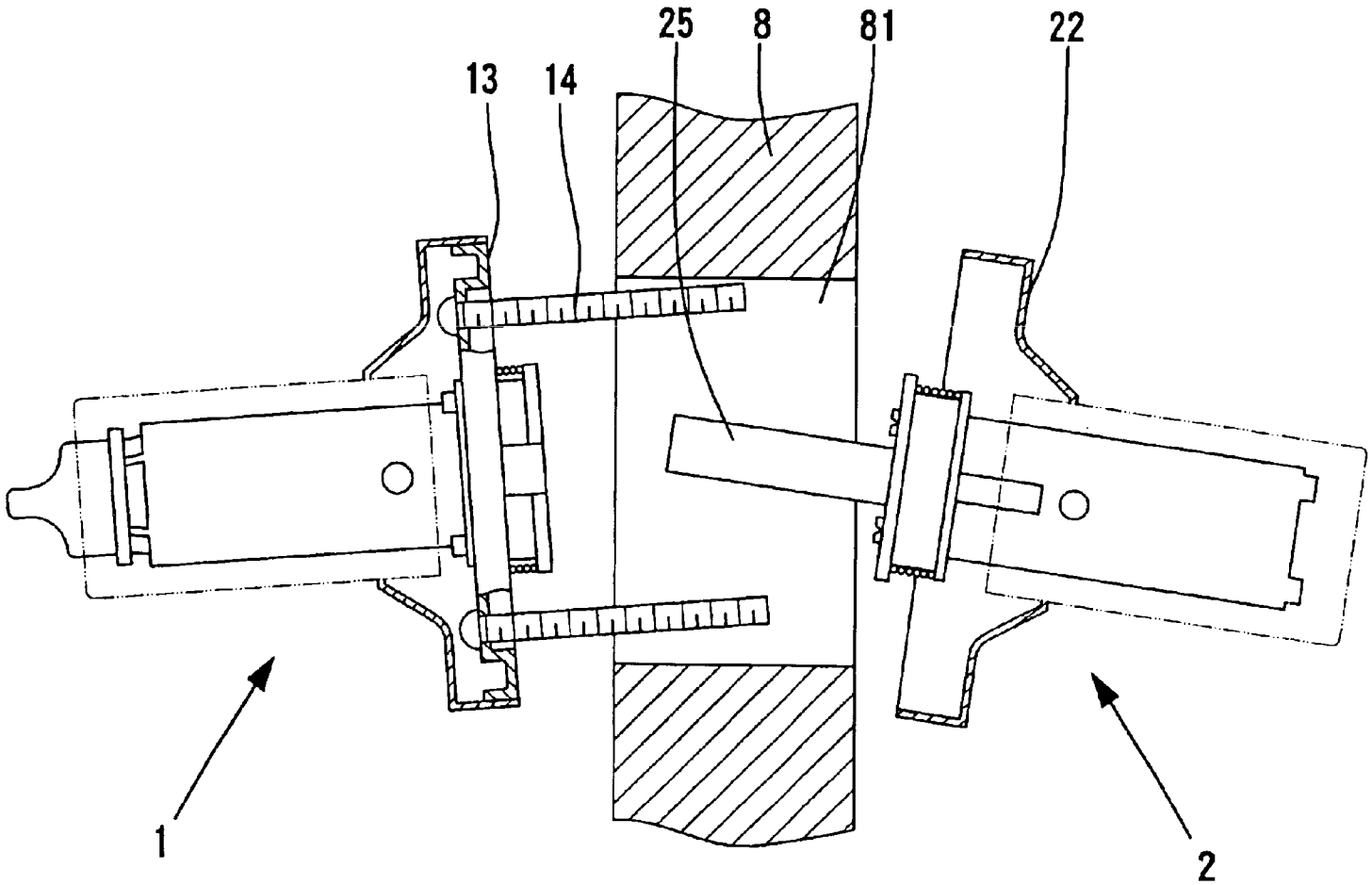
FIG. 3 PRIOR ART
FIG. 3 is a view similar to FIG. 2, illustrating destruction of the conventional tubular lock subjected to fire.
Figure 4:
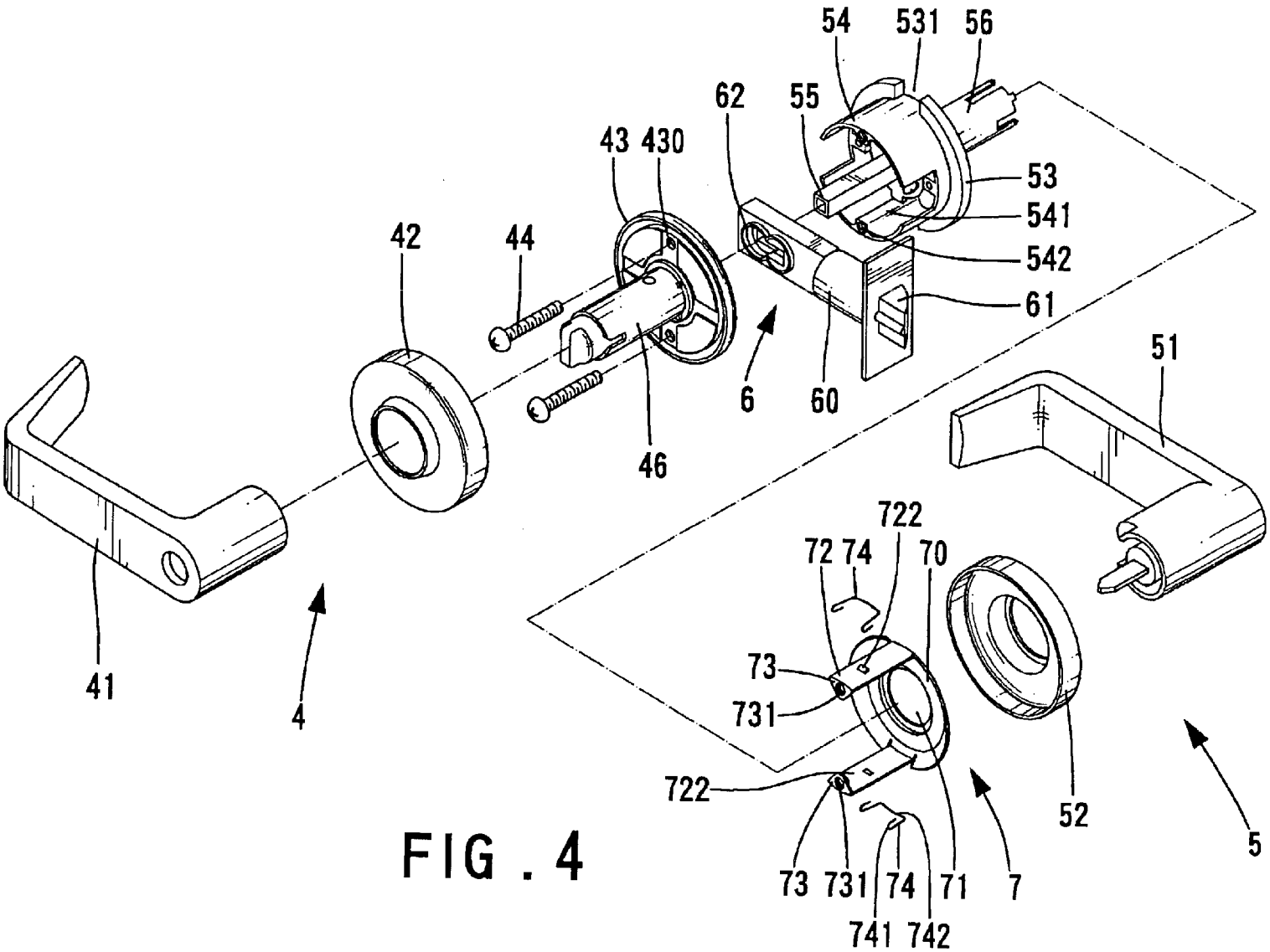
FIG. 4 is an exploded perspective view of a tubular lock in accordance with the present invention.
Figure 5:
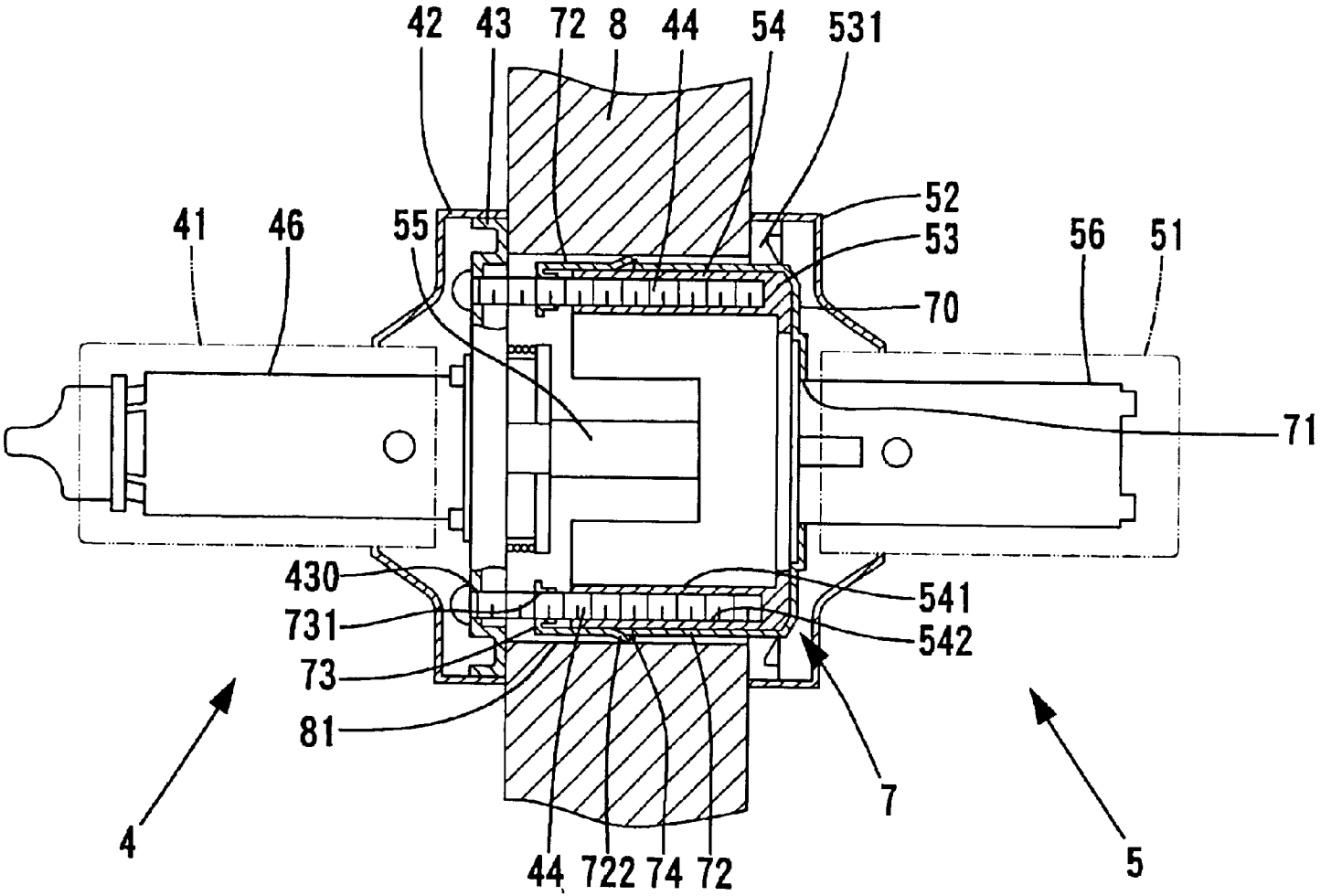
FIG. 5 is a sectional view of the tubular lock in accordance with the present invention.

Referring to FIGS. 4 and 5, a tubular lock in accordance with the present invention generally comprises an inside assembly 4, an outside assembly 5, and a latch mechanism 6. The inside assembly 4 includes an inside handle 41, an inside rose 42, an inside rose liner 43 mounted inside the inside rose 42, and an inside spindle 46 extending through the inside rose 42 and the inside rose liner 43. The outside assembly 5 includes an outside handle 51, an outside rose 52, an outside rose liner 53 mounted inside the outside rose 52, and an outside spindle 56 extending through the outside: rose 52 and the outside rose liner 53. A housing 54 is formed on an inner face of the outside rose liner 53, and a locking/unlocking bar 55 is mounted to an end of the outside spindle 56. The housing 54 includes two diametrically disposed mounting portions 541 each having a screw holes 542, and the inside rose liner 43 includes two holes 430 aligned with the screw holes 542.

The latch mechanism 6 is mounted between the inside rose liner 43 and the outside rose liner 53 and includes a casing 60, a latch 61, and a cam 62 that is operably connected to the latch 61 for retracting the latch 61 and that has a through-hole 621 through which the locking/unlocking bar 55 extends. When either handle 41, 51 is turned, the locking/unlocking bar 55 is turned to retract the latch 61 inward, achieving the unlatching operation.

Still referring to FIG. 4, the tubular lock in accordance with the present invention further includes a fireproof cover 7 made of a fireproof material. The fireproof cover 7 includes a longitudinal hole 71 in a ring portion 70 and through which the outside spindle 56 extends. Two legs 72 extend from a side of the fire proof cover 7 along a direction parallel to a longitudinal direction of the outside spindle 56. The legs 72 are preferably diametrically disposed on a peripheral edge of the fireproof cover 7. Preferably, the respective leg 72 has a length slightly greater than an axial length of the housing 54. Further, the respective leg 72 has an end piece 73 on a distal end thereof, with the end piece 73 being located in front of the respective mounting portion 541, and with the end piece 73 having a screw hole 731 aligned with the screw hole 542 of the respective mounting portion 541. Further, the respective leg 72 has a protrusion 722 on an outer face thereof.

To assist in mounting and positioning of the fireproof cover 7, the outside rose liner 53 includes two notches 531 through which the legs 72 of the fireproof cover 7 respectively extend. The respective notch 531 is located behind the respective mounting portion 541 of the housing 54. Thus, the fireproof cover 7 can be mounted to an outer side of the outside rose cover 52 and thus shields the outside rose cover 52, with the end piece 73 of the respective leg 72 being located in front of the respective mounting portion 541, and with the screw hole 731 of the respective leg 72 being aligned with the screw hole 542 of the respective mounting portion 541.

Figure 6:
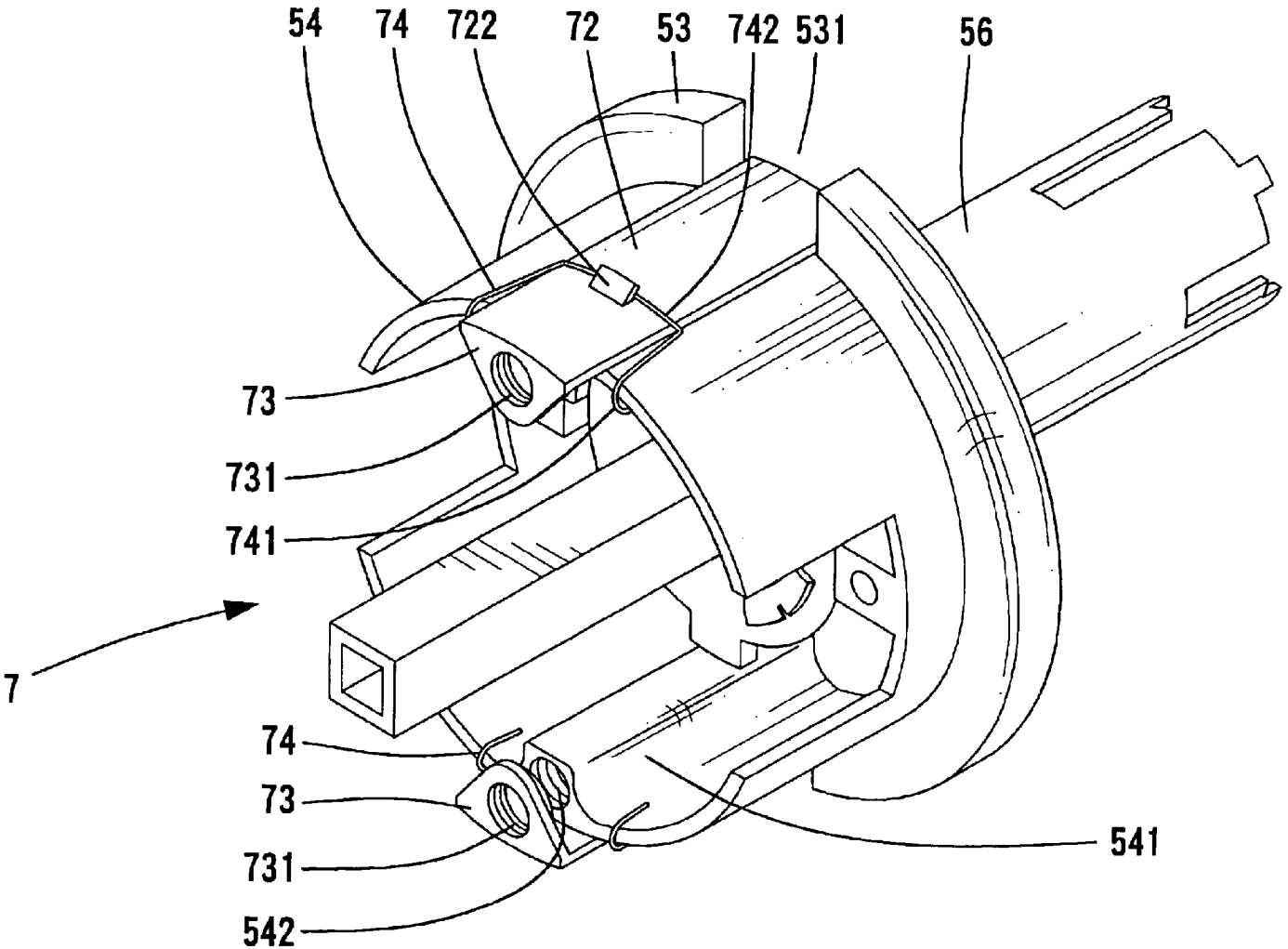
FIG. 6 is a perspective view illustrating engagement of a fireproof cover and an outside rose liner of the tubular lock in accordance with the present invention.

Further, two spring clips 74 are provided to retain the legs 72 of the fireproof cover 7 in place. The respective spring clip 74 is a substantially U-shaped member having two hooks 741 respectively on two distal ends thereof. As illustrated in FIG. 6, an intermediate portion 742 of the respective spring clip 74 abuts against the protrusion 722 of the respective leg 72 of the fireproof cover 7, with the hooks 741 of the respective spring clip 74 being engaged with an end wall of the housing 54. Thus, the respective leg 72 of the fireproof cover 7 is retained in place. Two screws 44 are respectively extended through the holes 430 of the inside rose liner 43 and the screw holes 731 of the fireproof cover 7 into the screw holes 542 of the mounting portions 541. The inside rose liner 43, the fireproof cover 7, and the outside rose liner 53 are thus engaged together, and the main portion of the lock is fixed in a borehole 81 of a door 8.

Figure 7:
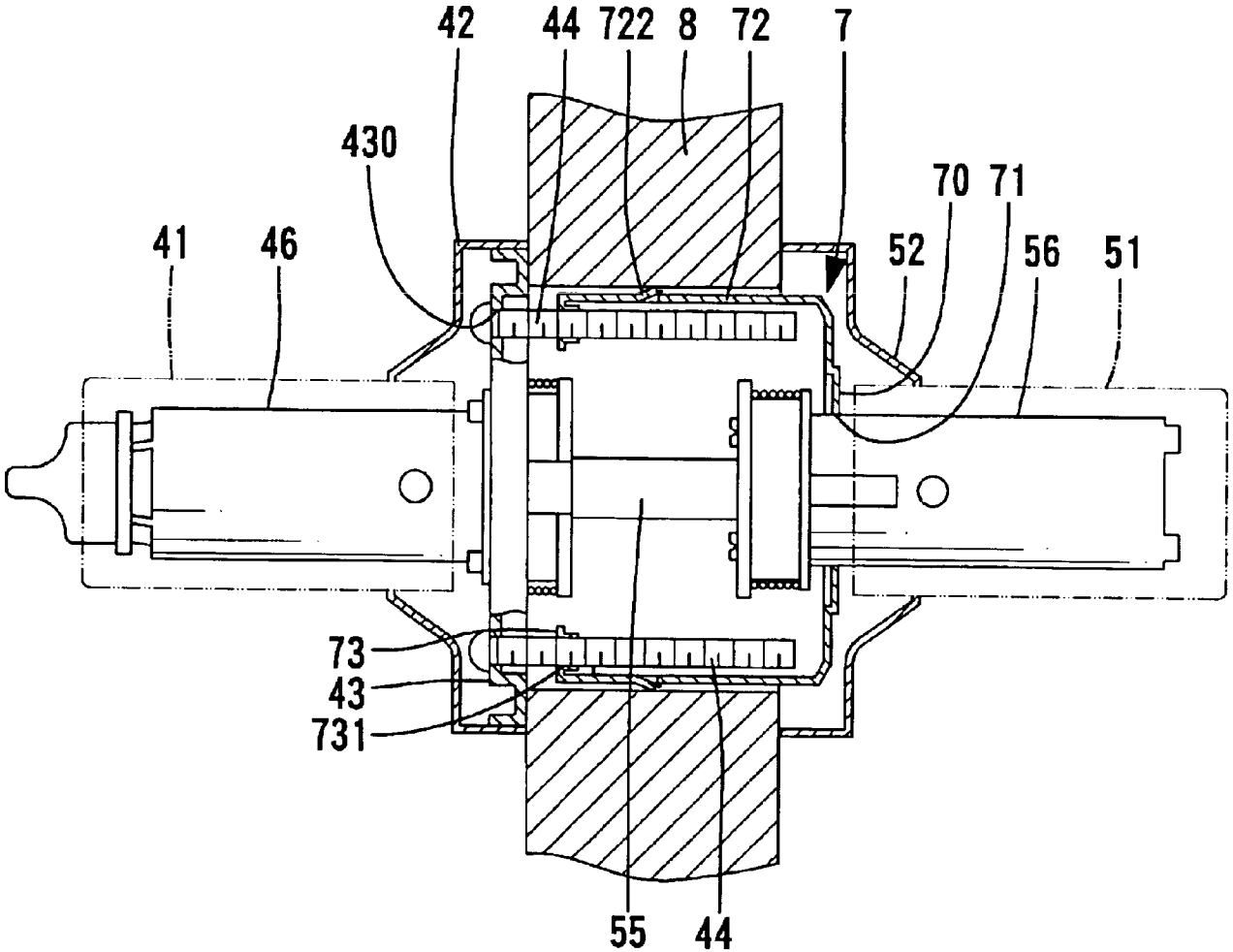
FIG. 7 is a sectional view showing fireproof effect of the fireproof cover in accordance with the present invention.

The fireproof cover 7 is made of a fireproof material, such as steel. Referring to FIG. 7, when the tubular lock in accordance with the present invention is mounted to a door 8, the outside rose liner 53 and the housing 54 with the mounting portions 541 may melt when subject to fire, yet the fireproof cover 7 will not melt (or at least delay the time of melting). Disengagement between the inside rose liner 43 and the outside rose liner 53 will not occur. Thus, when the tubular lock in accordance with the present invention is mounted to a fireproof door, a reliable and smoke barrier is provided while increasing the structural strength of the tubular lock itself.

Figure 8:
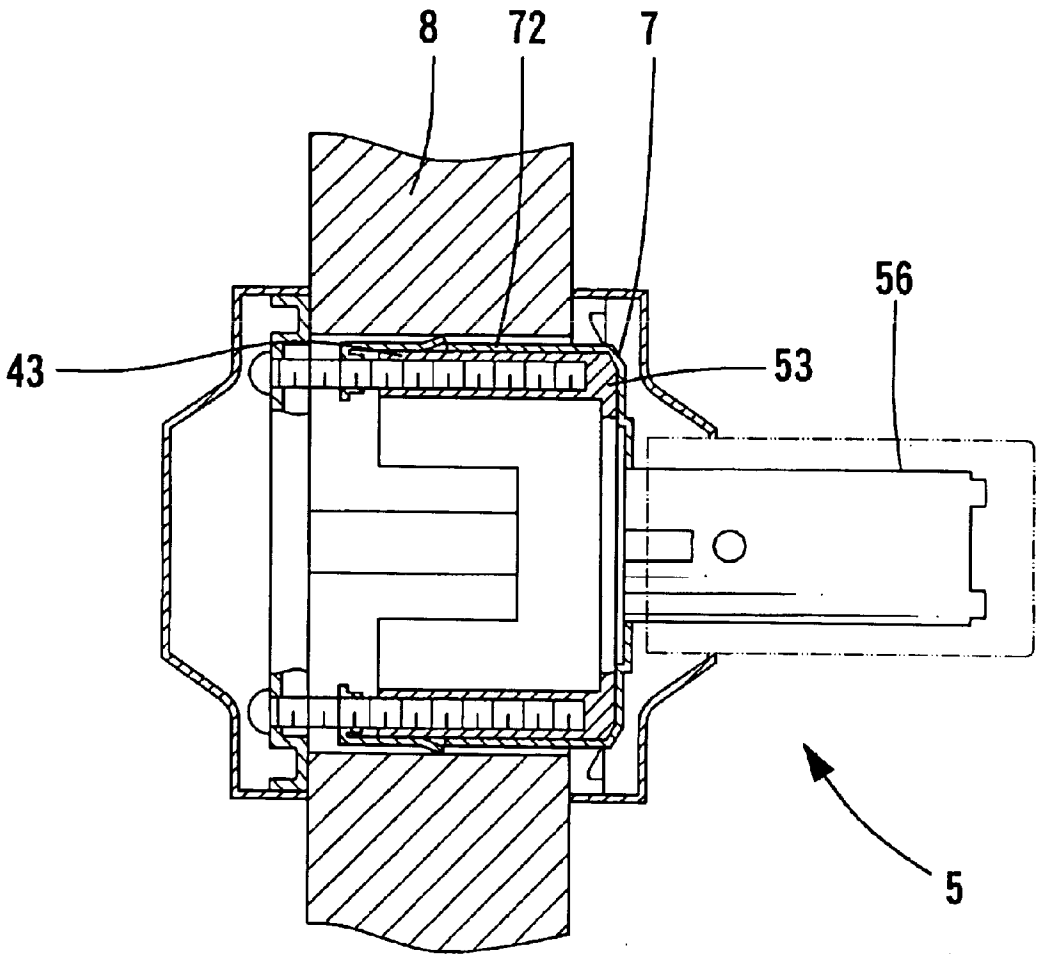
FIG. 8 is a sectional view illustrating use of the fireproof cover with a tubular lock of another type.

The fireproof cover 7 can be used with a tubular lock with a different inside assembly, as shown in FIG. 8. Namely, the inside spindle 46 and the inside handle 41 are omitted. It is noted that the fireproof cover 7 can be used with a tubular lock in which the outside spindle 56 and the outside handle 51 are omitted.

Although the invention has been explained in relation to its preferred embodiment, it is to be understood that many other possible modifications and variations can be made without departing from the scope of the invention as hereinafter claimed.

What is claimed is:

1. A tubular lock comprising:

an inside assembly including an inside rose and an inside rose liner;

an outside assembly including an outside rose and an outside rose liner;

a latch mechanism including a latch;

at least one of the inside assembly and the outside assembly including a spindle operably connected to the latch for retracting the latch and a handle connected to the spindle to turn therewith; and a fireproof cover including a longitudinal through-hole through which the spindle extends, the fireproof cover being mounted outside the outside rose liner and thus covering the outside rose liner;

the inside rose liner, the outside rose liner, and the fireproof cover being engaged together;

the outside rose liner including a housing extending from an inner face thereof, the housing including two mounting portions each having a screw hole, the inside rose liner including two holes respectively aligned with the screw holes of the outside rose liner, the fireproof cover including two legs each having an end piece on a distal end thereof, the respective end piece having a hole aligned with the respective screw hole of the outside rose liner, two screws being respectively extending through the holes of the inside rose liner and the holes of the fireproof cover into the screw holes of the outside rose liner.

2. The tubular lock as claimed in claim 1, wherein the fireproof cover is made of steel.

3. The tubular lock as claimed in claim 1, wherein the hole of the respective leg of the fireproof cover is a screw hole.

4. The tubular lock as claimed in claim 1, wherein the housing includes two notches through which the legs of the fireproof cover respectively extend.

5. The tubular lock as claimed in claim 1, wherein the respective leg of the, fireproof cover has a length slightly greater than an axial length of the housing.

6. The tubular lock as claimed in claim 1, wherein the respective leg of the fireproof cover includes a protrusion, further including two spring clips respectively attached to the protrusions for retaining the legs of the fireproof cover in place.

7. The tubular lock as claimed in claim 6, wherein the respective spring clip is a substantially U-shaped member including an intermediate portion and two hooks formed on two distal ends thereof, the intermediate portion of the respective spring clip abutting against the protrusion of the respective leg of the fireproof cover, with the hooks of the respective spring clip being engaged with an end wall of the housing.

* * * * *